US006953292B2

(12) United States Patent
Menendez et al.

(10) Patent No.: US 6,953,292 B2
(45) Date of Patent: Oct. 11, 2005

(54) MULTIPLE WEB PRINTING

(75) Inventors: Jorge Menendez, Barcelona (ES); Ignasi Vila, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 66 days.

(21) Appl. No.: 10/207,182

(22) Filed: Jul. 30, 2002

(65) Prior Publication Data

US 2004/0022568 A1 Feb. 5, 2004

(51) Int. Cl.[7] ..... B41J 11/44

(52) U.S. Cl. ..... 400/70; 400/61; 400/76; 400/578; 400/582; 347/104

(58) Field of Search ..... 400/578, 582, 400/70, 76, 61; 347/101, 104

(56) References Cited

U.S. PATENT DOCUMENTS

| | | | |
|---|---|---|---|
| 5,815,186 | A | 9/1998 | Lewis et al. |
| 5,838,354 | A | 11/1998 | Yamada et al. |
| 6,042,228 | A | 3/2000 | Yamada et al. |
| 6,168,269 | B1 | 1/2001 | Rasmussen et al. |

FOREIGN PATENT DOCUMENTS

JP 09286151 A * 11/1997 ..... B41J/15/04

* cited by examiner

*Primary Examiner*—Charles H. Nolan, Jr.

(57) ABSTRACT

Imaging by providing a plurality of webs, receiving a print job having one or more print images to be printed on the plurality of webs, and printing the one or more print images substantially simultaneously on one or more of the plurality of webs.

41 Claims, 9 Drawing Sheets

MULTIPLE WEB PRINTING

BACKGROUND OF THE INVENTION

It is generally known to use wide format inkjet printers in computer-aided design (CAD) printing applications. Typically with this type of printing, images are printed onto continuous substrates or webs. Similarly, it is well known to use inkjet printers for textile printing. A relatively high proportion of printing operations in the textile printing industry include patterns that are repeatedly printed onto continuous substrates. Graphic art also involves printing on continuous substrates. Output images of different sizes are often required in the above-mentioned printing applications.

It is well understood that operators of printers aim to maximize their throughput whilst minimizing their operating costs. To this end, some printers are arranged to accept webs of printing material of a range of different sizes. In this manner, an operator may select the size of a printing web to be used in relation to the size of the image to be printed. In this regard, the operator may be required to change web rolls each time a new web size is to be printed on. In so doing, however, the degree of waste web material and the operating costs may be reduced. Other printers simply require the operator to cut or trim the web once it has been printed on. However, such cutting and trimming operations can waste a significant amount of web material and time, and hence, may adversely affect the throughput of the printing operations.

SUMMARY OF THE INVENTION

According to one embodiment of the present invention there is provided a method of printing including providing a plurality of webs, receiving a print job having one or more print images to be printed on the plurality of webs, and printing the one or more print images substantially simultaneously on the plurality of webs.

According to another embodiment of the present invention there is provided a printer having a first side frame and a second side frame, wherein a spindle extends between the first and second side frames. A plurality of web rolls are mounted along the spindle, and have a plurality of webs feeding away therefrom along a web feed path. A print zone is positioned between the first and second side frames in which one or more of the plurality of webs are configured to substantially simultaneously receive images.

DETAILED DESCRIPTION

The present invention is not limited in its application to the details of any particular arrangement described or shown, since the present invention is capable of multitudes of embodiments without departing from the spirit and scope of the present invention. First, the principles of the present invention are described by referring to exemplary embodiments for simplicity and illustrative purposes. Although only a limited number of embodiments of the invention are particularly disclosed herein, one of ordinary skill in the art would readily recognize that the same principles are equally applicable to, and can be implemented in all types of imaging and printing devices.

Furthermore, numerous specific details are set forth below and in the figures to convey with reasonable clarity the inventors' possession of the present invention, an example of how to make and/or use the present invention, and the best mode in carrying out the present invention known to the inventors at the time of application. It will, however, be apparent to one of ordinary skill in the art that the present invention may be practiced without limitation to these specific details. In other instances, well known methods and structures have not been described in detail so as not to unnecessarily obscure the present invention. Finally, the terminology used herein is for the purpose of description and not of limitation. Thus, the following detailed description is not to be taken in a limiting sense and the scope of the present invention is defined by the claims and their equivalents.

Figure 1A:
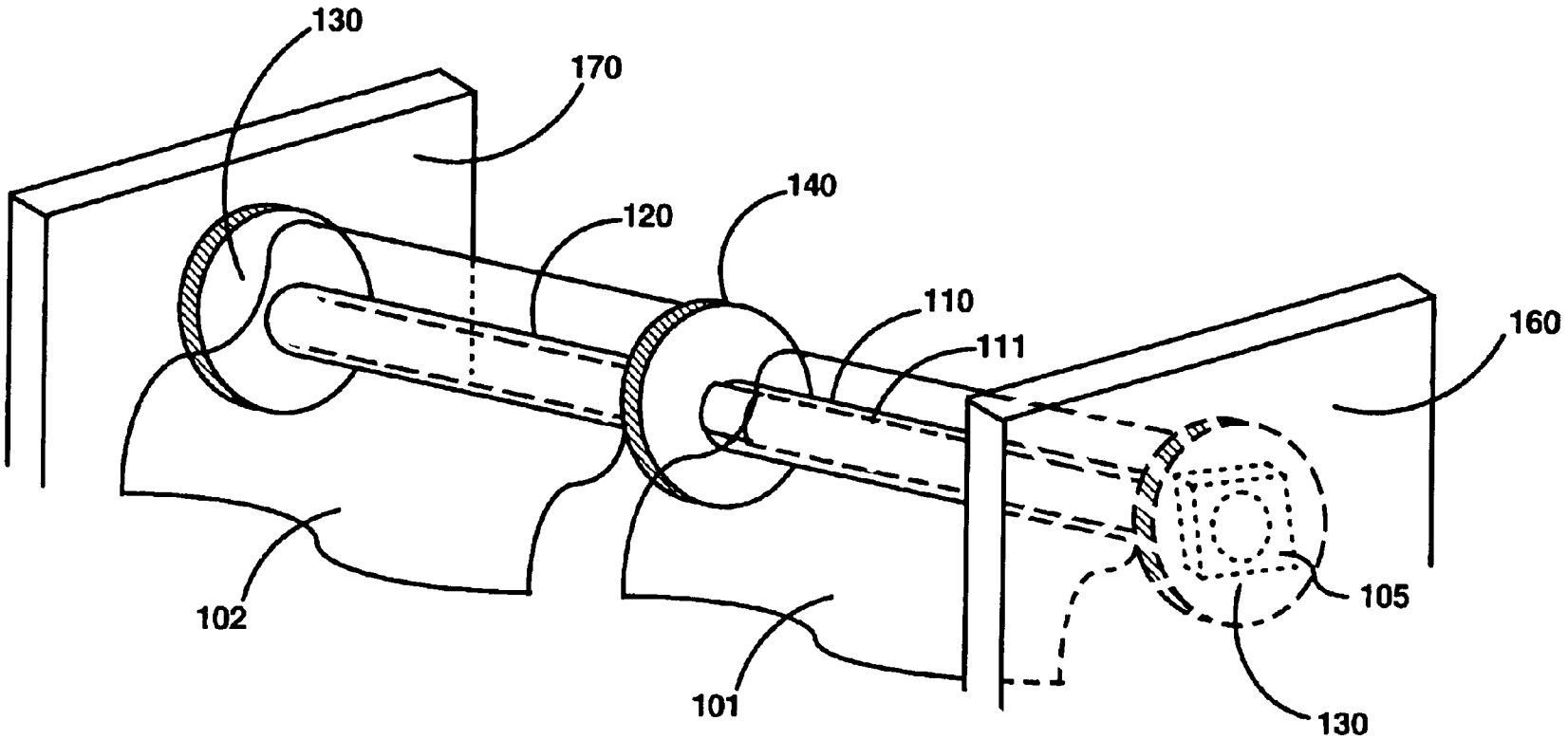
FIG. 1A is an exemplary illustration of a mounting arrangement for mounting a plurality of rolls to a printer, according to one embodiment of the invention.

Referring now specifically to the figures, FIG. 1A is an exemplary illustration of a mounting arrangement for mounting a plurality of rolls to a printer. FIG. 1A illustrates a spindle 111, releasably connected at one end to a first side frame 160, and at another end to a second side frame 170. The spindle 111 is connected to the side frames 160 and 170 via bearing members 105. The bearing members 105 may include spring-loaded contacts (not illustrated) to facilitate the releasable connection of the spindle 111 to the side frames 160 and 170 and also to bias the spindle 111 to one side.

FIG. 1A illustrates two web supply rolls 110 and 120 with webs 101 and 102 respectively. The core of both supply rolls may be any material including cardboard, plastic, and metal. In the illustrated position, the supply rolls 110 and 120 are mounted onto a spindle 111. There is a snug fit between the cores of the supply rolls 110 and 120 and the respective spindle 111. An expansion elastic component or plastic part (not shown) may be included on the spindle 111 to facilitate the snug fit.

FIG. 1A also illustrates connectors 130 and 140 at the ends of the spindle 111. The connectors 130 and 140 maintain substantially precise positioning of the webs 101 and 102 on the spindle 111 during web feeding operations. Connectors 130 are end caps and connectors 140 are double end cap connectors. Although FIG. 1A illustrates only one double end connector 140, there may be a plurality of double end connectors in any particular mounting arrangement.

Figure 1B:
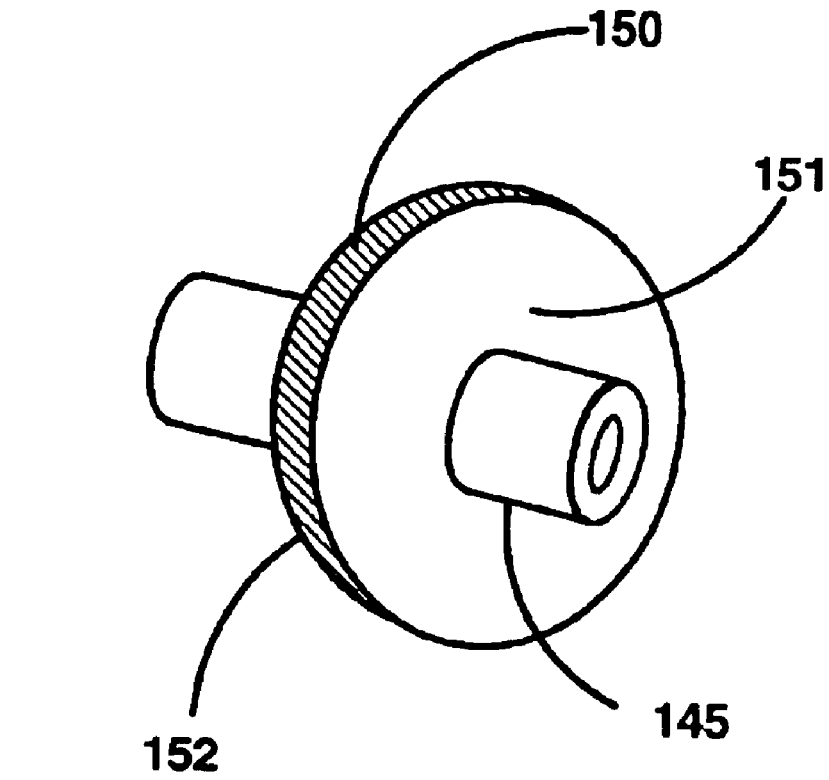
FIG. 1B is an exemplary illustration of the double end cap connector, according to an embodiment of the invention.

FIG. 1A shows the end caps 130 mounted at both ends of the spindle 111. FIG. 1B is an exemplary illustration of the double end cap connector 140 that is used to connect the supply rolls 110 and 120 on the spindle 111 in a coaxial side-by-side orientation. The double end cap connector 140 includes an inner ring portion 145 for slidably connecting to the spindle 111. The double end cap connector 140 also has an end flange 150 with opposed end flange surfaces 151 and 152 to maintain substantially precise positioning of the webs 101 and 102 during printer operations.

Figure 2A:
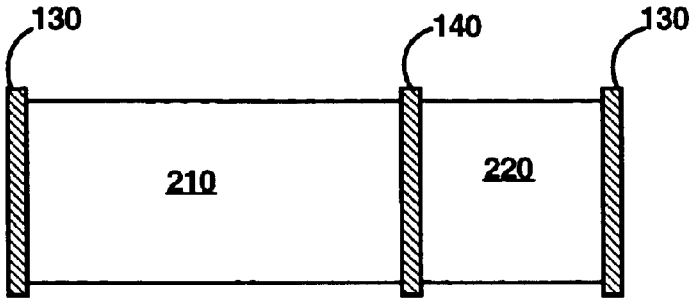
FIGS. 2A–2D are exemplary illustrations of various mounting arrangements for web rolls, according to an embodiment of the invention.
Figure 2B:
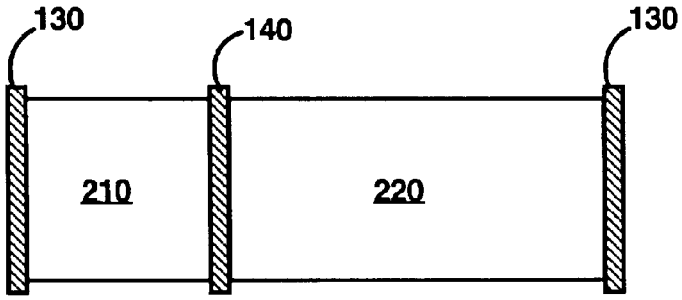

FIGS. 2A–2D are exemplary illustrations of possible mounting arrangements for mounting supply rolls. Although FIG. 1A illustrates a mounting arrangement that has two supply rolls 110 and 120 of substantially equal width, other arrangements are possible. FIGS. 2A and 2B show arrangements with supply rolls 210 and 220 of different widths for mounting to the printer to supply webs of different widths. The double end cap connector 140 is used to connect the rolls 210 and 220 in a coaxial side-by-side relation. This arrangement enables separate webs to be fed individually or simultaneously in a side-by-side orientation.

Figure 2C:
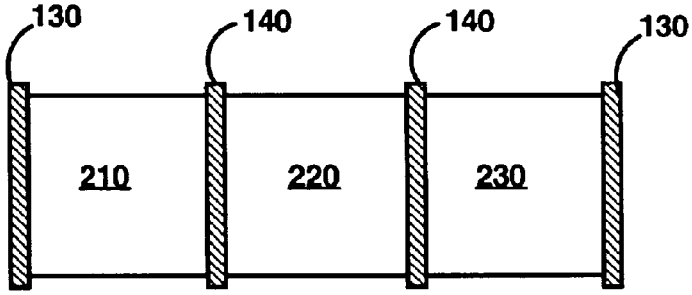
Figure 2D:
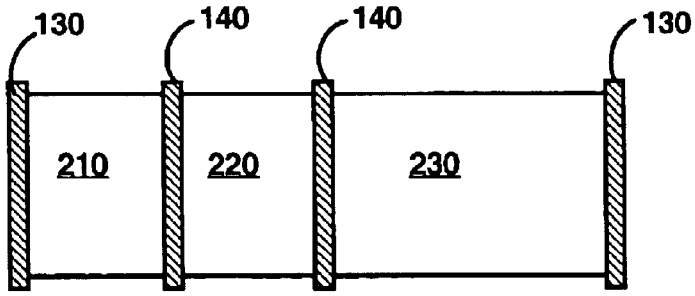

FIGS. 2C and 2D illustrate mounting arrangements in which three supply rolls 210, 220, and 230 are used. In these arrangements, two sets of double end cap connectors 140 are utilized for positioning and connecting the various supply rolls. FIG. 2C shows an exemplary arrangement in which the supply rolls 210, 220, and 230 are all substantially the same width. In FIG. 2D, the supply rolls 210 and 220 are substantially the same width, both of which are not as wide as the third roll 230. It should be noted that FIGS. 2A–2D illustrate only a few of the possible supply roll arrangements. For example, although it is not illustrated, it may be possible to use four or more supply rolls in a particular mounting arrangement according to other various embodiments of the invention.

Figure 3A:
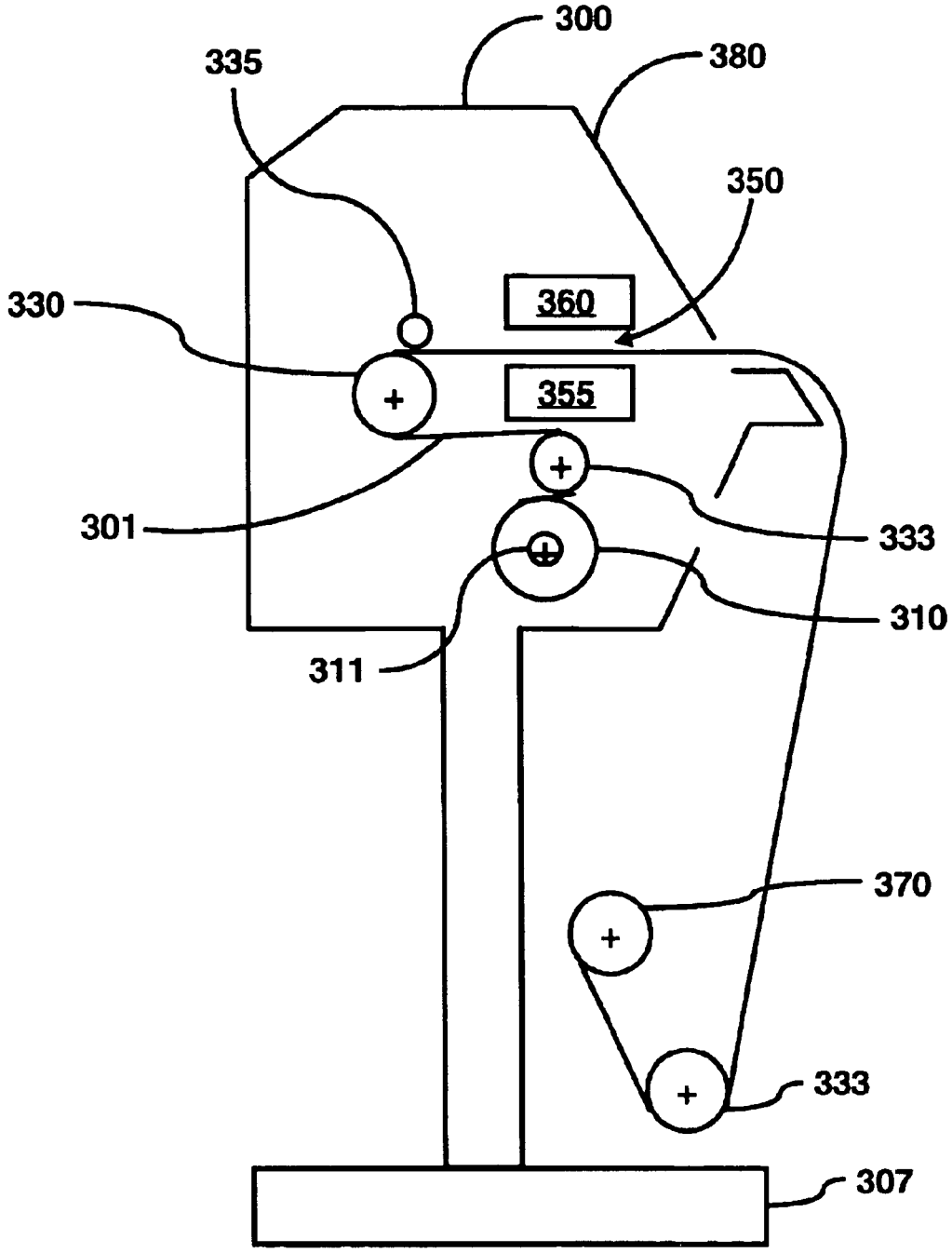
FIG. 3A is an exemplary cross sectional view of a printer according to an embodiment of the invention.

FIG. 3A is an exemplary cross sectional view of a printer 300 according to an embodiment of the invention. The printer 300 may feed one or more webs 301 through a printing zone 350. The one or more webs 301 are supplied from one or more supply rolls 310 and may be fed to one or more take-up rolls 370. FIG. 3A is a side view of the printer 300, such that only the leftmost edge of one web, supply roll, and take-up roll is seen. The other webs, supply rolls, and take-up rolls are hidden from view since they are in a co-axial, side-by-side relation to one another.

FIG. 3A shows the printer 300 being set on a stand with legs 307. FIG. 3A shows the supply roll 310 that maybe located at a lower front area of the printer 300. The supply roll 310 is mounted on a rotatable spindle 311, and is unwound to supply the web 301 that is fed through one or more freely rotatable feeding rollers 333 and a drive roller 330 that engages a pinch wheel 335. The web 301 is fed through the printing zone 350 for printing and then is fed to the take-up roll 370 via the feeding roller 333. The web is fed through the printer by the pulling forces exerted by the drive rollers 330 and the take-up roll 370. The drive rollers 330 and the take-up roll 370 may be powered by any suitable means. It should be noted that a reverse bias may be imparted on the spindle 311, in order to maintain proper web tensioning throughout the web feeding process.

Still referring to FIG. 3A, the printing zone 350 represents the location in which images are printed on the web 301. The term images includes, but is not limited to, graphic illustrations, symbols, photos, text, and the like. The printing zone 350 is defined by a platen 355 and one or more printheads 360. The platen 355 supports the web 301 during printing. The printheads 360 are mounted opposite the platen 355 to reciprocate across the web 301 in a direction substantially perpendicular to the feed direction of the web 301. The printheads 360 may include one or more ink cartridges (not shown) containing nozzles for producing the images. The printer 300 also includes a window 380 that may facilitate servicing of the printheads 360.

Figure 3B:
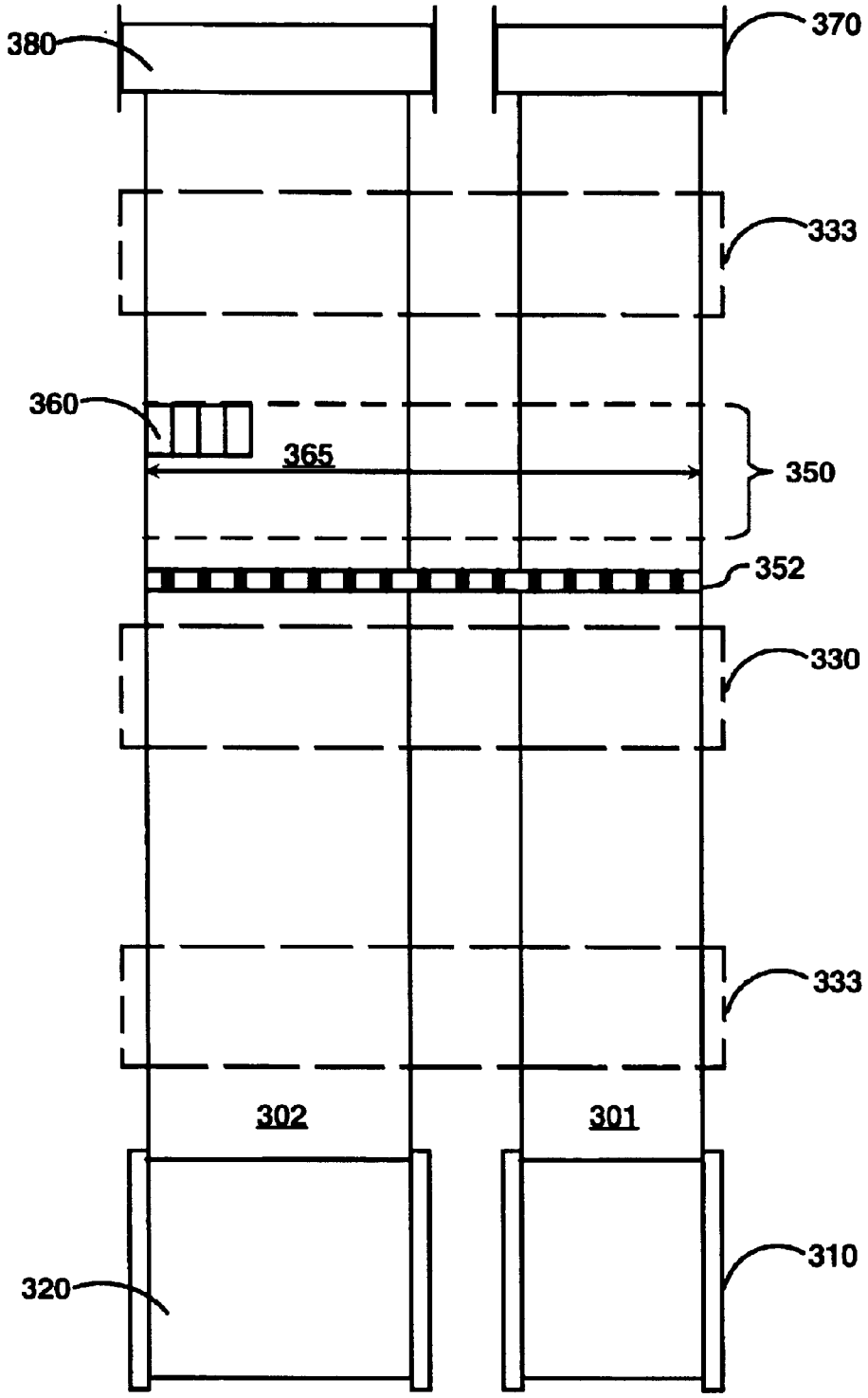
FIG. 3B is an exemplary illustrative view of a plurality of webs fed through the printer, according to an embodiment of the invention.

FIG. 3B is an exemplary illustrative view of a plurality of webs 301 and 302, being fed through the printer 300. Web 301 is fed from the supply roll 310 and web 302 is fed from the supply roll 320, both webs are fed through the printer for substantially simultaneous receiving of images. As illustrated, the supply roll 320 may have a width different than that of the supply roll 310. Alternatively, the rolls 310 and 320 may be of similar width. FIG. 3B shows the webs 301 and 302 being fed by drive rollers 330 through a printing zone 350, through feeding roller 333 and to take-up rollers 370 and 380 respectively. As stated above, proper web tensioning may be obtained by imparting a reverse bias on the spindle 311.

FIG. 3B also shows how the printheads 360 are arranged to traverse a print swath in the printing zone 350 as illustrated by arrow 365. The printing swath 365 is the path traveled by the printheads 360 during a printing pass. As illustrated, the operational envelope of the printing swath is such that the printheads 360 fully traverse the entire width across both webs 301 and 302. Also, the width of the print swath may correspond to the dimension of the printheads 360 in the media feed direction. As a result, the printhead 360 may print on both webs 301 and 302 during the same printing pass. Depending on the print job, the printhead 360 may print the same, different, or related images on the different webs 301 and 302.

With respect to the feeding rollers 333, it should be noted that the printer 300 may include any desired number of feeding rollers. The printer 300 may have more than two supply rolls for feeding more than two webs. When the printer has a plurality of supply rolls, the printer 300 may feed and print on the plurality of supply rolls simultaneously. Alternatively, the printer 300 may feed and print on one web at a time, or the printer 300 may simultaneously print on more than one but less than all of the webs at a given time. The printer 300 may feed a plurality of webs through the print zone 350, wherein images are printed on the more than one of the webs, but less than all of the webs passing through the print zone 350.

Also shown in FIG. 3B, is a media sensor 352 that is located across the feedpath for detecting web information, such as the presence or absence of various webs. The sensor 352 may be located in any location along the feed path, such as upstream of the print zone 350. The media sensor 352 may be used by the printer to detect the number of webs in the printing zone 350, and may also be used to determine which web(s) may be used to print different print jobs. The media sensor 352 is positioned for sensing the presence, width, and the location of the webs 301 and 302 as the webs 301 and 302 travel through the printing zone 350.

The media sensor 352 may be a photodetecting device such as a CCD (charged coupled device) array, CIS (contact image sensor), or the like. A CCD array may include photoconductive elements, for reading light intensities, and a processing unit for converting image density data to digital data. A CIS may include an illumination device, focusing optics, and sensor arrays in one package. The CIS may also include an analog/digital converter, a digital/analog converter and an operational amplifier. The media sensor 352 may also be a device, such as a light emitter and light detector pair that may be located on the carrier (not shown) that detects the presence of the webs as it moves back and forth across the print zone 350. The printer 300 may also include a media supply sensor (not shown) that detects the amount of media (web) remaining on the web supply rolls (310, 320). The media supply sensor (not shown) may be a photodetector or the like.

Figure 4:
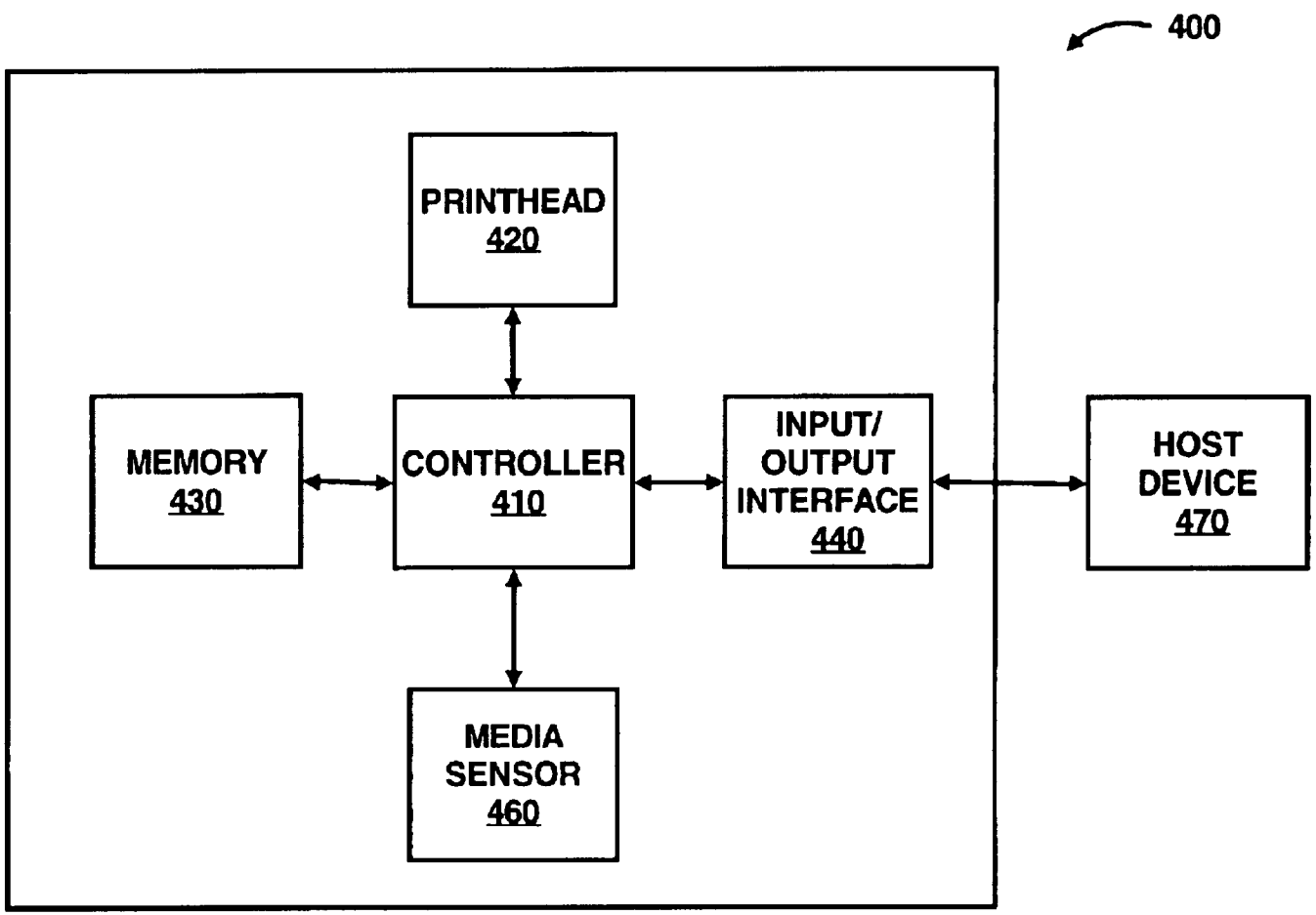
FIG. 4 is an exemplary block diagram of particular elements of a printer according to an embodiment of the invention.

FIG. 4 is an exemplary block diagram of particular elements of a printer 400 in accordance with an embodiment of the present invention. As will become better understood from a reading of the present disclosure, the following description of the block diagram of FIG. 4 outlines one manner in which a printer 400 may be operated. In this respect, it is to be understood that the following description is but one manner of a variety of different manners in which such a printer may be operated.

FIG. 4 illustrates a controller 410, a printhead 420, a memory 430, an input/output interface 440, and a media sensor 460. Also illustrated is a host device 470 such as a personal computer, network server, and the like. The controller 410 may be configured to provide control logic for the printer 400, which provides the functionality for the printer. In this, respect, the controller 410 may possess a microprocessor, a micro-controller, an application specific integrated circuit, or the like. The controller 410 may also include circuits to control the operation of the feeding rollers and other voltage receiving components (not shown).

The printhead 420 is configured to repeatedly pass across a substrate in individual, horizontal swaths or passes during a printing operation and to print patterns/images onto the media. As stated above, the controller 410 controls the operation of the printhead 420. This includes the operation of printhead components such as ink cartridges and nozzles, carrier belt and pulley systems and the like.

The controller 410 may be interfaced with a memory 430 configured to provide storage of computer software, firmware or hardware that provides the functionality of the printer 400 and may be executed by the controller 410. The memory 430 may be configured to provide a temporary storage area for data/file received by the printer 400 from the host device 470. The memory 430 may be implemented as a combination of volatile and non-volatile memory, such as dynamic random access memory ("RAM"), EEPROM, flash memory, and the like.

The controller 410 is interfaced with the media sensor 460. The media sensor 460 is configured to sense web information and transmit web information to the controller 410. The web information may include the number of webs in the print zone 350, the location of the webs in the print zone, and the width of the webs in the print zone. As outlined above, the media type sensor 460 may be a CCD array, a CIS, or the like, and may be located across a web-feeding path. Web information is transmitted to the controller 410. The controller 410 may use the web information to control the operation of the printer 400 during print jobs. Depending on the web information detected by the media type sensor 460, the print controller 410 may reformat print information to correspond to the detected information.

The controller 410 is further interfaced with an I/O interface 440 configured to provide a communication channel between the host device 470 and the printer 400. The I/O interface 440 may conform to protocols such as RS-232, parallel, small computer system interface, universal serial bus, etc.

In operation, the host device 470 sends print job information to the controller 410. Each print job has information that contains the image(s) to be printed, and may also have additional information about the job, such as the width of the media to be printed upon. The controller 410 includes formatting circuitry or software that formats the print job information. The controller 410 may format the print job for printing on a plurality of webs substantially simultaneously. This may involve formatting to print a particular image of a particular size on a web of corresponding width. When printing simultaneously on a plurality of webs, the controller 410 may determine from the print job information whether to print similar or different images on different webs. Therefore, depending on the print job information, each web may receive a different image/pattern or alternatively, all the webs may receive similar images/patterns. The controller 410 may also determine printing parameters such as plot width, the amount of ink fired per scan, printhead scanning rate, and web advance rate.

The controller 410 utilizes feedback information sent by the media sensor 460, relating the number of webs being used, the width of the webs being used, and the location of the webs in the print zone. If the formatted print job has images that do not correspond to the width of the webs and/or the number of webs, and/or the locations of the webs, printing may be suspended and a user may be informed via a display (not shown) that a web change is required. A web change may include changing all the webs, adding or subtracting at least one web supply, or the like.

Figure 5A:
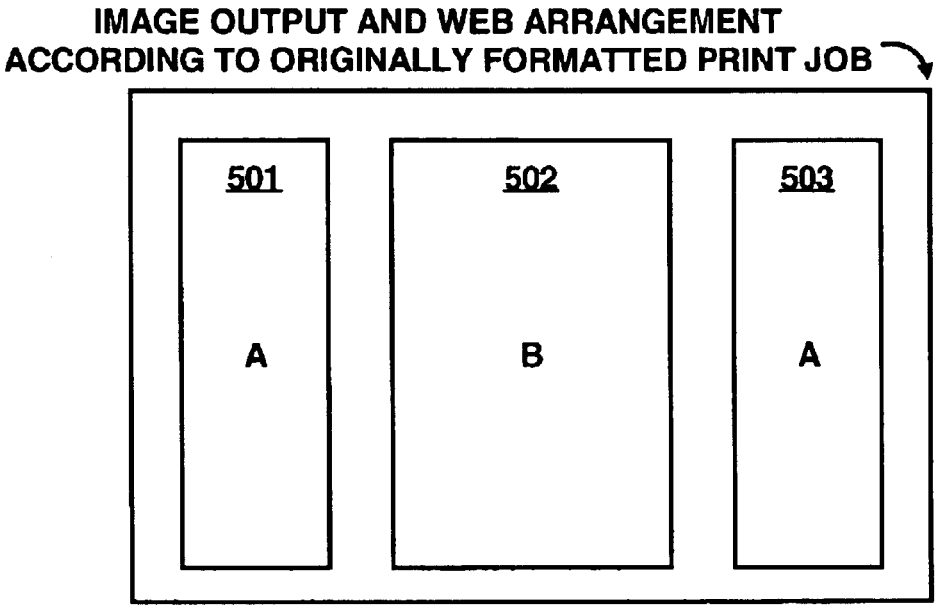
FIGS. 5A–5D are exemplary illustrations, showing web arrangements and image outputs, according to an embodiment of the invention.

Alternatively, in response to a situation where the print job includes images that do not correspond to the width, location, or number of webs in the printer, the print job may be reformatted in order to have the image correspond with the webs. FIGS. 5A–5D provide examples of such occurrences. FIG. 5A illustrates the image output and web arrangement according to an originally formatted print job. The original print job is formatted for a web arranged as illustrated in FIG. 5A, i.e., from left to right, 501, 502, and 503. The webs 501 and 503 are of substantially similar width, and web 502 wider than the other two webs. As initially formatted, the output image is from left to right 'A' 'B' 'A' with the image/pattern 'A' assigned to the webs of similar width, 501 and 503. The image/pattern 'B' is wider than the image 'A', and is designed to be printed on the widest web 502.

Figure 5B:
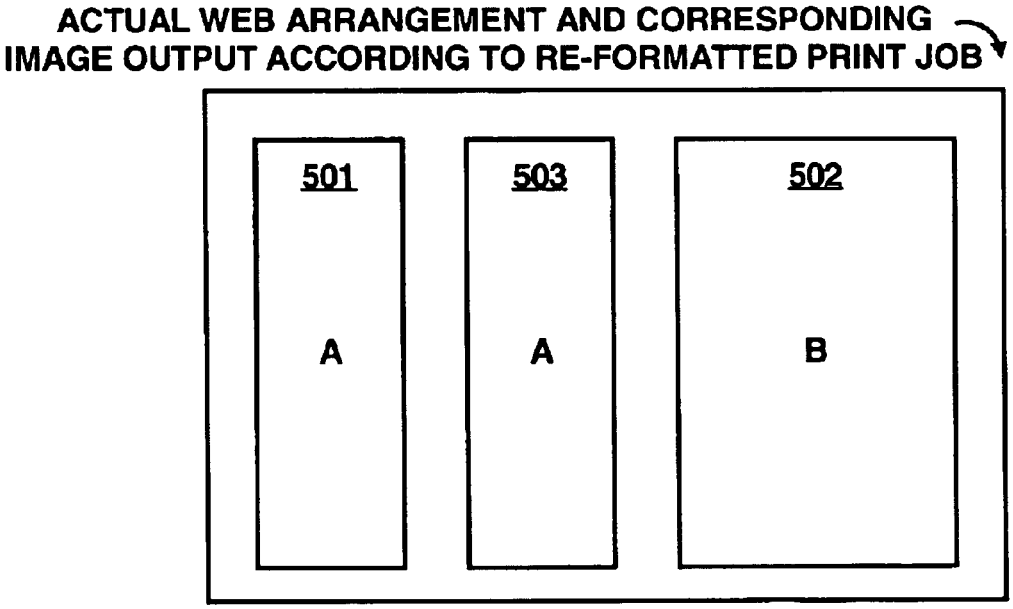

FIG. 5B illustrates the actual detected web arrangement, and the corresponding reformatted image output. In operation, the sensor 460 detects number of webs, the location of the webs, and the width of the webs. The sensor 460 detects a web arrangement from left to right: 501, 503, and 502, i.e., the webs of equal width next to each other, with the widest web to the right. The detected arrangement is not the web arrangement according to the originally formatted print job. If the output pattern were printed as planned 'A' 'B' 'A', the widest image 'B' would be placed on a web that does not correspond to the width of the image 'B'. However, the sensor 460 detects the arrangement of the webs illustrated in FIG. 5B, and transmits this information to the controller 410. Based on the detected web information, the controller reformats (corrects) the print job so that images/patterns of a particular size are printed on webs of corresponding widths. As illustrated, the actual printout from left to right is 'A' 'A' 'B'.

Figure 5C:
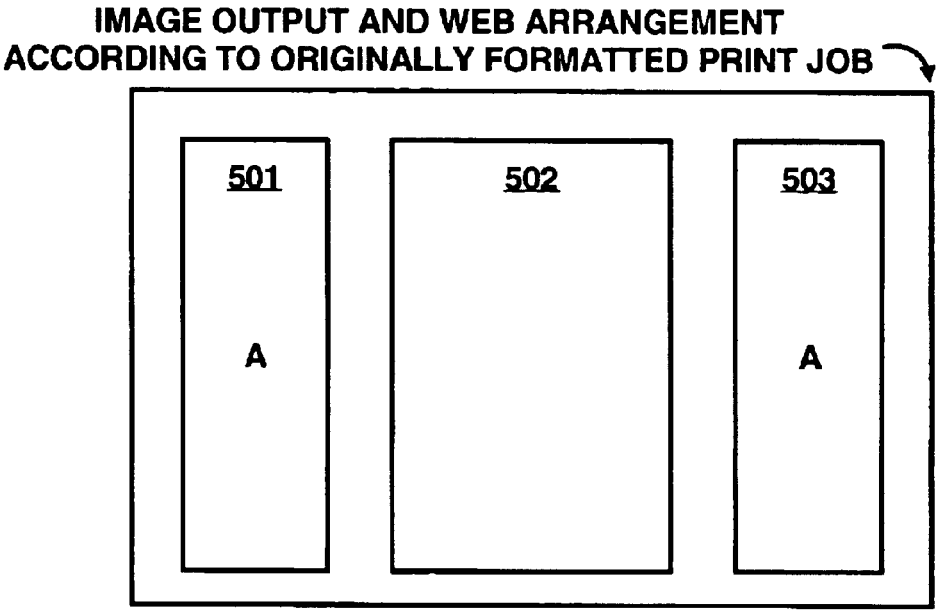
Figure 5D:
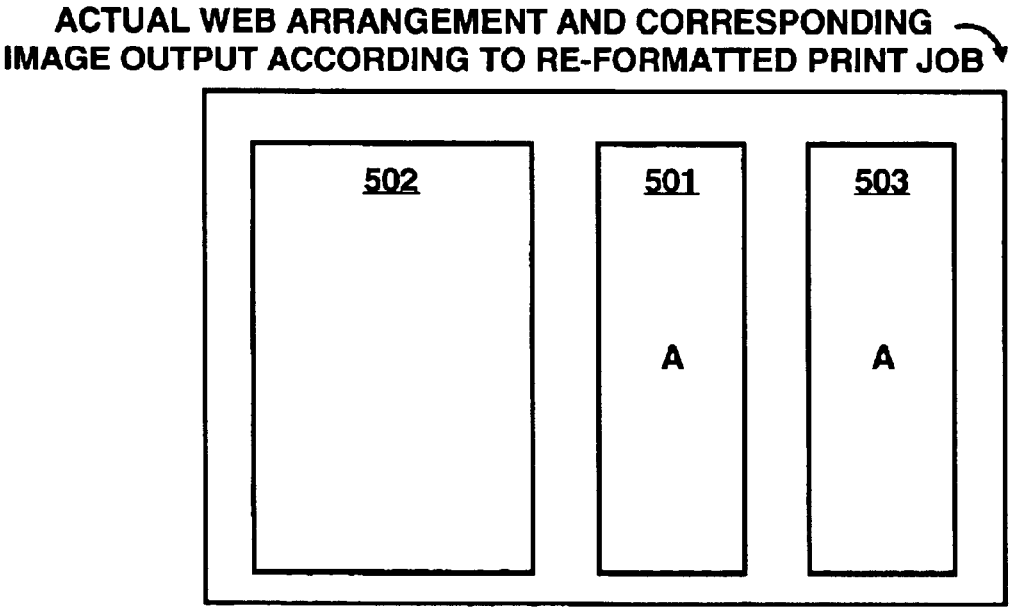

Reformatting may also be performed in situations in which, more than one, but less than all of the webs receive images. This is explained with reference to FIGS. 5C and 5D. A situation may exist where the originally formatted print job, as illustrated in FIG. 5C, requires no image on the widest web 502, but images 'A' on webs 501 and 503. FIG. 5D represents the actual arrangement of the webs, which does not correspond to the originally formatted print job. After the sensor 460 detects the actual arrangement of the webs, the controller 410 may reformat the print job. As illustrated in FIG. 5D, the printer may then print the images 'A' on the corresponding webs 501 and 503, while printing no image on web 502. Although the above examples outline a situation with three webs, the reformatting of images may take place in situations involving any reasonable number of webs.

Figure 6:
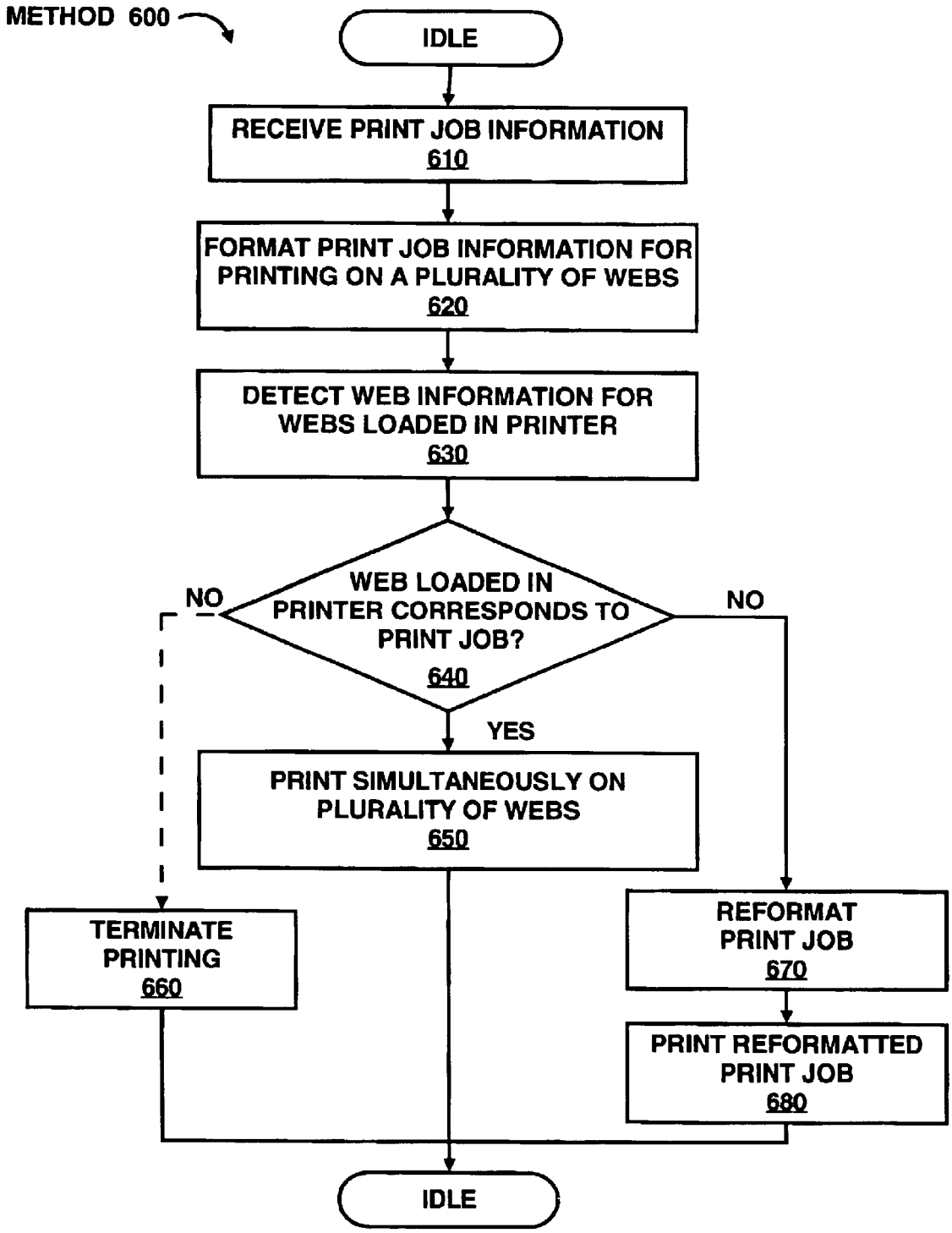
FIG. 6 is an exemplary flowchart illustrating a method of printing according to an embodiment of the present invention.

FIG. 6 is a flowchart of a method 600 of substantially simultaneous printing on a plurality of webs according to an embodiment of the present invention. At step 610, the printer 400 receives a print job from a host device 470. The print job has information that contains the image(s) to be printed, and may include additional information about the print job, such as the width of the media to be printed upon. The controller 410 then formats the print job for simultaneous printing on a plurality of webs at step 620. At step 630, the web information pertaining to webs loaded in the printer are detected. In this regard, the sensor 460 may detect the number of webs in the printing zone, the width of the webs in the printing zone, and the location of the webs in the printing zone.

In step 640, the controller 410 determines when the loaded webs correspond with the formatted print job. The determination is based on web information detected by the sensor 460, which is then compared to the formatted print job information. According to the web information, the printer controller 410 may either proceed to print an output image as formatted at step 650. Alternatively, the controller 410 may terminate printing, at step 660. Alternatively, the controller 410 may reformat the print job and then proceed to print an output image at step 670. At step 670, if the arrangement of webs in the print zone does not correspond to the formatted job, the printer may reformat the job so that the images are properly arranged on the receiving webs. At step 680, the output images, according to the reformatted print job, are printed onto the receiving webs. Following steps 650, 660, and 680, the printer 400 may go into an idle mode.

It should be noted that although the specification refers to inkjet printers, the mounting arrangement is applicable to other types of web feed printers besides inkjet printers. For instance, the multiple web feeding arrangement may be incorporated in thermal printers, laser printers, and the like. Laser or thermal printers may be arranged in a similar manner to the arrangement illustrated in FIGS. 3A and 3B, where a thermal printhead (as opposed to an ink cartridge) is mounted for reciprocal motion on a carrier. Printheads used in these apparatuses may also be of the stationary type that span the entire width of the web(s).

What has been described and illustrated herein are but a few embodiments of the invention along with some variations. The terms, descriptions and figures used herein are set forth by way of illustration only and are not meant as limitations. For instance, the multiple roll supply system may be implemented in printers other than plotters. Those skilled in the art will recognize that many variations are possible within the spirit and scope of the invention, which is intended to be defined by the following claims and their equivalents in which all terms are meant in their broadest reasonable sense unless otherwise indicated.

What is claimed is:

1. A method of printing comprising:

providing a plurality of webs;

receiving a print job having one or more print images to be printed on said plurality of webs;

printing said one or more print images substantially simultaneously on two or more of said plurality of webs;

sensing said plurality of webs for web characteristics, said print job further having image characteristics; and formatting said image characteristics of said print job to said web characteristics of said plurality of webs.

2. The method as claimed in claim 1, further comprising the steps of:

determining whether said image characteristics of said print job correspond to said web characteristics of said plurality of webs;

suspending printing in response to said image and web characteristics not corresponding; and changing at least one of said print job and one or more of said plurality of webs to correspond said image and web characteristics.

3. The method as claimed in claim 2, wherein said characteristics of said print job comprise at least one of quantity and width of said one or more print images, further wherein said characteristics of said plurality of webs comprise at least one of quantity, width, and location of said plurality of webs.

4. The method as claimed in claim 3, wherein said formatting step comprises matching each of said one or more print images to a respective one of said plurality of webs based on at least one of said image and web characteristics.

5. The method as claimed in claim 4, wherein said printing step comprises simultaneously printing three print images of said one or more print images on three separate webs of said plurality of webs.

6. A method of printing comprising the steps of:

providing a plurality of webs for receiving an image;

sensing said plurality of webs for web characteristics including at least one of quantity, width, and location;

receiving a print job having one or more print images, said print job further having image characteristics including at least one of quantity and width;

formatting said image characteristics of said print job to correspond to said web characteristics of said plurality of webs; and printing said one or more print images substantially simultaneously on said plurality of webs.

7. The method as claimed in claim 6, wherein said formatting step comprises matching said one or more print images to a respective one of said plurality of webs based on at least one of said image and web characteristics.

8. The method as claimed in claim 7, wherein formatting further comprises matching the widths of said one or more print images to respective widths of said plurality of webs.

9. The printer as claimed in claim 11, further comprising means for positioning said plurality of web rolls substantially coaxially adjacent to one another.

10. The printer as claimed in claim 11, further comprising:

means for supporting said plurality of web rolls, said means for supporting having opposite ends; and means for mounting said means for supporting at said opposite ends thereof.

11. A printer configured to accept a plurality of web rolls, said printer comprising:

means for unwinding said plurality of web rolls to feed out a plurality of webs;

means for receiving a print job having one or more print images to be printed on said plurality of webs;

means for printing said one or more print images substantially simultaneously on two or more of said plurality of webs;

means for sensing said plurality of webs for web characteristics, said print job further having image characteristics; and means for formatting said image characteristics of said print job to said web characteristics of said plurality of webs.

12. The printer as claimed in claim 9, wherein said means for positioning said plurality of web rolls is slidably mounted to said means for supporting so as to accommodate web rolls of various widths.

13. The printer as claimed in claim 11, further comprising:

means for changing at least one of said means for printing and said plurality of web rolls.

14. A printer comprising:

a first side frame and a second side frame;

a spindle extending from the first side frame to the second side frame;

a plurality of web rolls mounted along said spindle, said plurality of web rolls having a plurality of webs feeding away therefrom along a feed path of said printer; and a print zone between said first and second side frames, wherein one or more of said plurality of webs are configured to substantially simultaneously receive images in said print zone.

15. The printer as claimed in claim 14, further comprising at least one connector adjustably mounted to said spindle for positioning said plurality of web rolls substantially coaxially adjacent to one another.

16. The printer as claimed in claim 15, wherein said at least one connector is slidably mounted to said spindle such that said at least one connector is variably positionable along the spindle to facilitate adjacently mounting web rolls of various widths.

17. The printer as claimed in claim 14, further comprising:

a sensor mounted across said feed path for sensing web characteristics of said plurality of webs including at least one of quantity, width, and location; and means for receiving a print job to be printed on said plurality of webs, said print job having one or more print images, said print job further having image characteristics including at least one of quantity and width of said one or more print images.

18. The printer as claimed in claim 17, further comprising:

means for formatting said image characteristics of said print job to correspond to said web characteristics of said plurality of webs; and means for printing said one or more print images substantially simultaneously on one or more of said plurality of webs.

19. A computer readable storage medium on which is embedded one or more computer programs, said one or more computer programs implementing a method for printing, said one or more computer programs comprising a set of instructions for:

sensing a plurality of webs for web characteristics including at least one of quantity, width, and location;

receiving a print job having one or more print images, said print job further having image characteristics including at least one of quantity and width;

formatting said image characteristics of said print job to correspond to said web characteristics of said plurality of webs; and printing said one or more print images substantially simultaneously on said plurality of webs.

20. The computer readable storage medium according to claim 19, said one or more computer programs further comprising a set of instructions for:

matching said one or more print images to a respective one of said plurality of webs based on at least one of said image and web characteristics.

21. The computer readable storage medium according to claim 20, said one or more computer programs further comprising a set of instructions for:

matching the widths of said one or more print images to respective widths of said plurality of webs.

22. A method of printing comprising:

providing a plurality of webs coaxially mounted on a spindle;

sensing the plurality of webs for web characteristics;

receiving a print job having one or more print images to be printed on the plurality of webs; and printing the one or more print images substantially simultaneously on two or more of the plurality of webs.

23. The method as claimed in claim 22, further comprising:

sensing the plurality of webs for web characteristics, the print job further having image characteristics; and formatting the image characteristics of the print job to the web characteristics of the plurality of webs.

24. The method as claimed in claim 22, further comprising:

sensing the plurality of webs for web characteristics, the print job further having image characteristics;

formatting the image characteristics of the print job to the web characteristics of the plurality of webs;

determining whether the image characteristics of the print job correspond to the web characteristics of the plurality of webs;

suspending printing in response to the image and web characteristics not corresponding; and changing at least one of the print job and one or more of the plurality of webs to correspond the image and web characteristics.

25. The method as claimed in claim 22, further comprising:

sensing the plurality of webs for web characteristics, the print job further having image characteristics; and formatting the image characteristics of the print job to the web characteristics of the plurality of webs, wherein the characteristics of the print job comprise at least one of quantity and width of the one or more print images, further wherein the characteristics of the plurality of webs comprise at least one of quantity, width, and location of the plurality of webs.

26. The method as claimed in claim 22, further comprising:

sensing the plurality of webs for web characteristics, the print job further having image characteristics; and formatting the image characteristics of the print job to the web characteristics of the plurality of webs, wherein formatting comprises matching each of the one or more print images to a respective one of the plurality of webs based on at least one of the image and web characteristics.

27. The method claimed in claim 22, wherein printing comprises simultaneously printing three print images of the one or more print images on three separate webs of the plurality of webs.

28. The method as claimed in claim 22, wherein printing comprises feeding the plurality of webs through a print zone, wherein images are printed on more than one of the webs, but less than all of the webs passing through the print zone.

29. A method of printing comprising:

coaxially mounting a plurality of webs on a common spindle, each of the plurality of webs for receiving an image;

sensing the plurality of webs for web characteristics including at least one of quantity, width, and location;

receiving a print job having one or more print images, the print job further having image characteristics including at least one of quantity and width;

formatting the image characteristics of the print job to correspond to the web characteristics of the plurality of webs; and printing the one or more print images substantially simultaneously on the plurality of webs.

30. The method as claimed in claim 29, wherein formatting comprises matching the one or more print images to a respective one of the plurality of webs based on at least one of the image and web characteristics.

31. The method as claimed in claim 29, wherein formatting further comprises matching the widths of the one or more print images to respective widths of the plurality of webs.

32. The method as claimed in claim 29, wherein printing comprises feeding the plurality of webs through a print zone, wherein images are printed on more than one of the webs, but less than all of the webs passing through the print zone.

33. A method of printing comprising:

providing a plurality of web rolls each having a respective associated web;

coaxially mounting the plurality of web rolls on a common spindle;

positioning each of the plurality via a plurality of double end cap connectors each configured to mount between adjacent ones of the web rolls, each of the plurality of double end cap connectors including an inner ring portion configured to adjustably couple to the spindle, each double end cap connector including an end flange with opposed end flange surfaces configured to maintain substantially precise positioning of the adjacent web rolls and their associated webs during printer operations;

receiving a print job having one or more print images to be printed on the plurality of webs; and printing the one or more print images substantially simultaneously on two or more of the plurality of webs, wherein printing comprises feeding the plurality of webs through a print zone, wherein images are printed on more than one of the webs, but less than all of the webs passing through the print zone.

34. The method as claimed in claim 33, further comprising:

sensing the plurality of webs for web characteristics, the print job further having image characteristics; and formatting the image characteristics of the print job to the web characteristics of the plurality of webs.

35. The method as claimed in claim 33, further comprising:

sensing the plurality of webs for web characteristics, the print job further having image characteristics;

formatting the image characteristics of the print job to the web characteristics of the plurality of webs;

determining whether the image characteristics of the print job correspond to the web characteristics of the plurality of webs;

suspending printing in response to the image and web characteristics not corresponding; and changing at least one of the print job and one or more of the plurality of webs to correspond the image and web characteristics.

36. The method as claimed in claim 33, further comprising:

sensing the plurality of webs for web characteristics, the print job further having image characteristics; and formatting the image characteristics of the print job to the web characteristics of the plurality of webs, wherein the characteristics of the print job comprise at least one of quantity and width of the one or more print images, further wherein the characteristics of the plurality of webs comprise at least one of quantity, width, and location of the plurality of webs.

37. The method as claimed in claim 33, further comprising:

sensing the plurality of webs for web characteristics, the print job further having image characteristics; and formatting the image characteristics of the print job to the web characteristics of the plurality of webs, wherein formatting comprises matching each of the one or more print images to a respective one of the plurality of webs based on at least one of the image and web characteristics.

38. The method as claimed in claim 33, wherein printing comprises simultaneously printing three print images of the one or more print images on three separate webs of the plurality of webs.

39. A computer readable storage medium on which is embedded one or more computer programs, said one or more computer programs implementing a method for printing, said one or more computer programs comprising a set of instructions for:

sensing a plurality of webs for web characteristics including at least one of quantity, width, and location;

receiving a print job having one or more print images, said print job further having image characteristics including at least one of quantity and width;

formatting said image characteristics of said print job to correspond to said web characteristics of said plurality of webs; and printing said one or more print images substantially simultaneously on said plurality of webs, wherein printing comprises feeding the plurality of webs through a print zone, wherein images are printed on more than one of the webs, but less than all of the webs passing through the print zone.

40. The computer readable storage medium according to claim 39, said one or more computer programs further comprising a set of instructions for matching said one or more print images to a respective one of said plurality of webs based on at least one of said image and web characteristics.

41. The computer readable storage medium according to claim 40, said one or more computer programs further comprising a set of instructions for matching the widths of said one or more print images to respective widths of said plurality of webs.

* * * * *